United States Patent [19]

Griffin

[11] 3,945,708

[45] Mar. 23, 1976

[54] ELECTRICAL CONNECTOR WITH PREMOLD

[75] Inventor: Richard H. Griffin, Riverside, R.I.

[73] Assignee: International Telephone and Telegraph Corporation, Nutley, N.J.

[22] Filed: Mar. 28, 1975

[21] Appl. No.: 563,023

[52] U.S. Cl. ..... 339/189 R; 339/218 R
[51] Int. Cl.[2] ..... H01R 19/28
[58] Field of Search ..... 339/218, 63, 188, 189

[56] References Cited

UNITED STATES PATENTS

| | | | |
|---|---|---|---|
| 2,906,986 | 9/1959 | Schaefer | 339/218 R |
| 2,924,806 | 2/1960 | Hubbell et al. | 339/91 R |
| 3,239,791 | 3/1966 | Fyrk | 339/63 R |
| 3,487,353 | 12/1969 | Massa | 339/218 R |
| 3,624,591 | 11/1971 | Buberniak | 339/196 M |

*Primary Examiner*—Roy Lake
*Assistant Examiner*—Neil Abrams
*Attorney, Agent, or Firm*—John T. O'Halloran; Menotti J. Lombardi, Jr.

[57] ABSTRACT

A locking receptacle for electrical connectors includes a premold which holds the wire contacts in position and prevents insulation from overflowing into the contacts during molding. The premold is a cylindrical form of rigid high melting point thermoplastic insulating material having differently shaped passages and slots for a plurality of female contacts and connecting leads and includes an end closure member. The elements are assembled together, mounted in a mold and overmolded with a lower melting point resilient insulation covering in a simplified molding process to form an integral water-tight unit.

9 Claims, 6 Drawing Figures

ELECTRICAL CONNECTOR WITH PREMOLD

BACKGROUND OF THE INVENTION

1. Field of the Invention

The present invention concerns an electrical locking connector and particularly an internal premold therefore which secures the contacts during molding and provides a barrier to insulation overflow.

2. Description of the Prior Art

Female electrical locking receptacles presently employed in cord sets generally have contacts attached to the ends of insulated wires in an assembly which is molded in a suitable low temperature resilient thermoplastic material. The contacts must be individually and carefully mounted in position on long load pins within the mold before being encapsulated in the plastic insulation. The removal from the mold after cooling has also been somewhat difficult and slow, and the long load pins have been subject to frequent breakage. In addition, the molten plastic material often flows into the openings for the contacts and requires later removal. Other locking receptacles, such as used in wiring devices, usually have the contacts molded within a more rigid higher temperature thermoplastic material and require separate external connection of the leads before it can be used. One such device of this type is shown in U.S. Pat. No. 2,924,806, issued Feb. 9, 1960, wherein a rigid insert or locking plate, having slots to receive a male connector, is molded into the receptacle to retain a mating rotatable cap against withdrawal and locate the slot openings. This, however, did not serve to hold the receptacle contacts in position during molding or prevent the molten insulation from penetrating the slots.

SUMMARY OF THE INVENTION

It is therefore the primary object of the present invention to provide an electrical locking receptacle for a cord set with an internal member which holds the contacts in a desired position and provides a barrier against overflow of insulation into the contacts during a simplified molding operation.

This is achieved by a novel cylindrical premold form of rigid high temperature melting point thermoplastic insulation material having longitudinal passages and arcuate slots for a plurality of wires and female contacts and a closure member at the end. The assembled elements are mounted on short lead pins in a mold and encapsulated with a lower melting point resilient thermoplastic material to provide a water-tight integral cord set. This permits use of reduced quantities of thermoplastic material, shortens mold loading and removal cycles, and reduces load pin breakage. Other objects and advantages will become apparent from the following description taken in conjunction with the accompanying drawings.

DESCRIPTION OF THE PREFERRED EMBODIMENT

Figure 1:
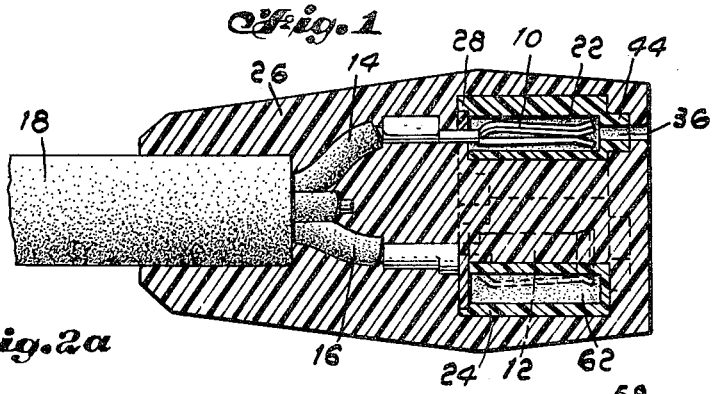
FIG. 1 shows a partial cross-section of the assembled contacts, lead wires and premold of a molded cord set.
Figure 2A:
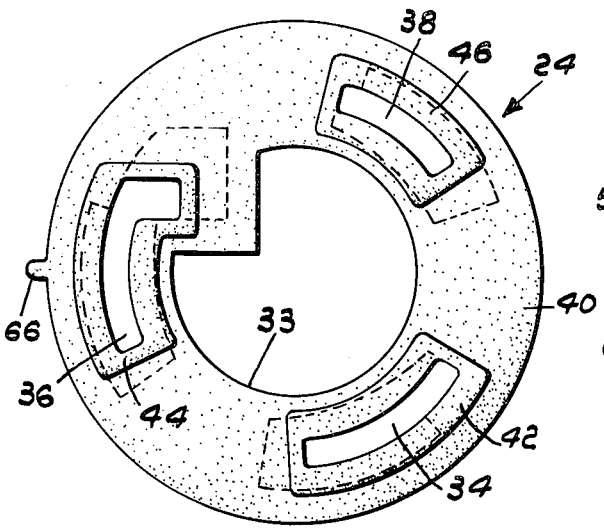
FIGS. 2*a*, 2*b* and 2*c* show front, rear and side section views of the premold.
Figure 2B:
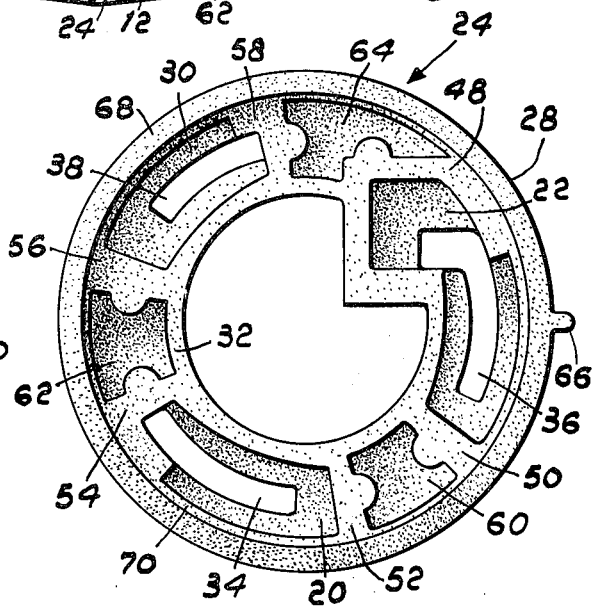
Figure 2C:
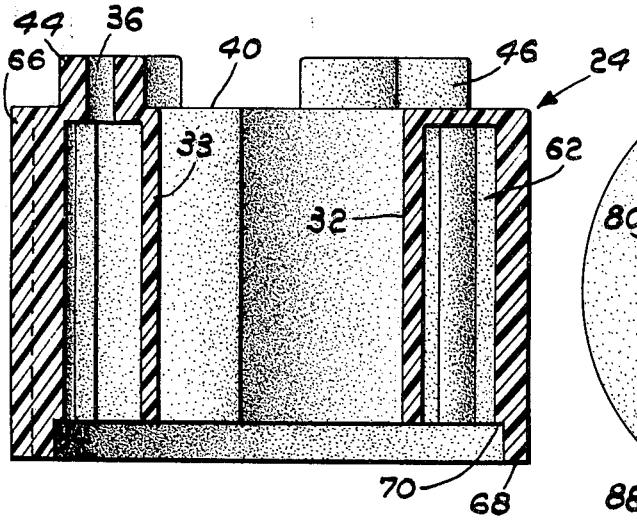

As shown in FIG. 1, a locking electrical connector includes female receptacle contact members 10, 12 connected to the respective ends of insulated wires 14, 16 extending from an insulated cord or cable 18. A third wire and contact are not shown. The contact members are arcuately curved and positioned within radially disposed longitudinal passages 20, 22, 30 in a cylindrical premold 24, which is shown in more detail in FIGS. 2*a*, 2*b* and 2*c*. The curvature of the contacts to receive like shaped blades is required in order to achieve locking action wherein the male blade is inserted into the slot and contact and is twisted or rotated to engage an inner surface of the premold. The entire assembly is molded within a suitable resilient low melting point thermoplastic insulating material covering or jacket 26 such as polyvinylchloride (PVC). Rubber may also be utilized.

The premold is preferably made of nylon or other relatively rigid high melting point thermoplastic insulation material and is formed in a previous molding operation not described here. Another suitable material is styrene. The premold includes an outer cylindrical wall 28 having three arcuate radially spaced longitudinal passages 20, 22, 30 to receive the three female contacts. An inner cylindrical wall 32 around an open central bore 33 provides the inner boundary of each passage. The front ends of the passages have small different sized curved slots or openings 34, 36, 38 in the front face 40 enclosing the contacts to receive cooperating blades of a male plug member, not shown. Each of the curved slots on the face of the premold has like shaped bosses 42, 44, 46 extending around the edges of the openings. The bosses provide a given spacing between the internal contacts and the front end of the thermoplastic outer covering 26 which is molded over the assembled premold and contacts. During the molding operation, load pins, not shown, having the shape of the male plug members, are incorporated in the mold and engage the contacts through the premold slots to form the corresponding openings in the front end of outer covering 26 which is molded over the front face and body of the premold.

Radially arranged longitudinal partitions 48, 50, 52, 54, 56, 58 in the premold provide the opposite walls of arcuate passages 22, 20, 30 and of hollow core holes 60, 62, 64 extending between the passages to the front face 40. The core holes are for the purpose of eliminating unnecessary insulation material in the premold form. A raised longitudinal nip or porjection 66 on the outer surface of the premold cylindrical wall 28 serves to indicate the location of the top of the premold for placement in the mold during the final outer cover insulation molding operation.

Figure 3A:
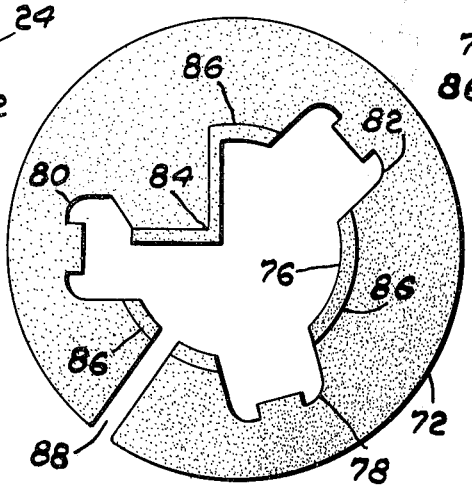
FIGS. 3*a* and 3*b* show front and side views of the premold end closure member.
Figure 3B:
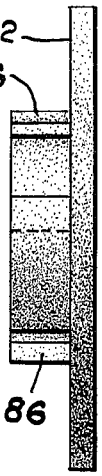

The back end of the premold includes a thin cylindrical wall portion 68 and an inner annular shoulder 70 spaced from the end to accommodate an end closure member or back cover 72, as shown in more detail in FIGS. 3*a* and 3b. The closure member fits within the wall 68 against shoulder 70, the end of inner cylindrical wall 32, and the ends of longitudinal partitions 48, 50, 52, 54, 56, 58. The closure member is in the form of a thin flat disc having a central opening 76. The opening includes three radially spaced notches 78, 80, 82 which accommodate the wire connecting back ends of the three female contact members 10, 12 and one which is not shown. A right angled or L-shaped rectangular corner portion 84 extending into the central opening matches a like-shaped longitudinal passage 22 which accommodates a key member from the mating blade of the male plug. This insures insertion of the matching blades into the associated contact members.

Thin shoulders 86 extending internally around the periphery of central opening 76, except for the radial notches, fit over the edges within the central bore 33 of inner cylindrical wall 32 to aid in preventing insulation from entering the premold and contacts. A radial slit 88 provides flexibility and facilitates the assembly of the contact elements and insertion of the end closure member into the premold. The three lead wires with the female contacts are preferably identified by color code to position the elements in the desired premold passages for molding. Thus, a green ground wire 14 and contact 10 are positioned in passage 22 within the premold and notch 80 of the rear cover. This passage has the L-shaped slot 36 and rectangular extension for the keyed male plug member and is adjacent the locating nip 66. A black wire 16 designated as a "hot" lead and contact 12 are located adjacent slot 34 in passage 20 and notch 78; and a white wire, which also connects indirectly to ground and a contact, not shown, are positioned adjacent a smaller slot 38 in passage 30 and notch 82. The front ends of the female contact members are positioned close to and aligned with respective slots 34, 36, 38, which receive the corresponding blades of the male plugs. The rear cover 72 is inserted into the back end of the premold to complete the assembly.

The separately assembled premold with the internal contacts is then placed in a mold on short load pins which fit into the slots on the front face of the premold. The mold is closed and the covering 26 of thermoplastic material is molded around the premold, the extending back ends of the contacts, wires and cord to seal all of the elements into the final cord set assembly. The higher melting point plastic material of the premold is not affected by the lower temperature melting of the cover material during the molding. The premold thus provides an internal barrier to the molten cover insulation which does not enter the premold or contacts, and the entire assembly is sealed into the proper fixed position upon cooling. Use of relatively short strong load pins reduces breakage of the pins. The molding cycle is simplified and more rapid since less loading and unloading time is required, and less material is used for the thermoplastic insulation covering. The premold and cover may be made of various sizes for different current and power requirements. In addition, a plurality of like premolds and covers may be combined to provide multiple connectors such as in a cube tap having three locking receptacles molded together with an interconnecting member in an integral unit.

While only a single embodiment has been illustrated and described, it is apparent that many variations may be made in the particular design and configuration without departing from the scope of the invention as set forth in the appended claims.

What is claimed is:

1. A premold for a molded electrical connector comprising:

an outer cylinder of a relatively high melting point rigid thermoplastic material;

a plurality of hollow passages extending between the opposite ends of said cylinder;

a plurality of inner longitudinal walls separating said passages, said passages and walls being adapted to retain and enclose a plurality of female electrical contact members;

a front face having a plurality of openings at the front end of respective ones of said passages, said openings being adapted to receive a plurality of male connector blades engageable with said female contact members;

an end closure member receivable within the back end of said cylinder, said end closure member having a central opening to receive said plurality of female contact members;

said inner longitudinal walls including an inner cylinder and longitudinal partitions, said passages being disposed radially to receive said contact members between said inner and outer cylinders and said longitudinal partitions;

said openings in said front face being arcuate slots enclosing correspondingly curved female contact members to receive like curved rotatable male connector blades;

said closure member including a plurality of radially positioned notches around said central opening adapted to receive reduced width wire connecting portions of said contact members;

external raised embossments surrounding said arcuate slots on said front face;

one of said arcuate slots including an L-shaped notch adapted to receive a key member of a correspondingly shaped male blade; and said closure member further including inner shoulders extending around the edges of said central opening between said notches, said shoulders engaging the inner wall of said inner cylinder.

2. The device of claim 1 wherein said high melting point rigid thermoplastic material is nylon.

3. The device of claim 1 further including a plurality of longitudinal core holes positioned between respective ones of said passages and separated from said passages by said partitions.

4. The device of claim 1 wherein the outer surface of said outer cylinder includes a raised longitudinal projection.

5. An electrical connector comprising:

an inner cylindrical premold of a relatively high melting point rigid thermoplastic insulating material;

a plurality of hollow passages extending between the front and back ends of said premold;

a plurality of inner longitudinal walls separating said passages;

a plurality of female electrical contact members enclosed in respective ones of said passages;

a front face at said front end having a plurality of openings therein aligned with the adjacent ends of respective ones of said contact members and adapted to receive a plurality of male connector blades engageable with said female contact members;

an end closure member closing the back end of said premold, said closure member having a central opening receiving said plurality of contact members;

an insulated wire cord;

a plurality of insulated wire conductors extending from an end of said cord and connected to respective ones of said contact members; and an outer covering of a relatively low melting point resilient insulating material enclosing said premold, said end of said wire cord and the extending wire conductors, and having a plurality of openings in the front end of said covering aligned with said premold openings;

said inner longitudinal walls including an inner cylinder and longitudinal partitions, said passages being disposed radially to receive said contact members between said inner cylinder, the inner wall of said premold and said longitudinal partitions; and said closure member including a plurality of radially positioned notches around said central opening adapted to receive reduced width wire conductor connecting portions of said contact members and inner shoulders extending around the edges of said central opening between said notches, said shoulders engaging the inner wall of said inner cylinder.

6. The connector of claim 5 wherein said high melting point rigid thermoplastic insulating material is nylon.

7. The connector of claim 5 wherein said openings and contact members are curved to receive correspondingly curved rotatable male connector blades.

8. The connector of claim 7 wherein said premold includes raised curved embossments around the openings on said front face spacing said outer covering on said front face from said contacts within said premold.

9. The connector of claim 8 wherein said low melting point resilient insulating material is polyvinylchloride.

* * * * *